US007059879B2

(12) United States Patent
Krause et al.

(10) Patent No.: US 7,059,879 B2
(45) Date of Patent: Jun. 13, 2006

(54) ELECTRICAL CONNECTOR HAVING A PISTON-CONTACT ELEMENT

(75) Inventors: John A. Krause, Medina, OH (US); Tiebin Zhao, Medina, OH (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/849,533

(22) Filed: May 20, 2004

(65) Prior Publication Data

US 2005/0260876 A1 Nov. 24, 2005

(51) Int. Cl.
*H01R 29/00* (2006.01)

(52) U.S. Cl. ..... 439/181

(58) Field of Classification Search ..... 439/181, 439/921, 205.6, 923, 693
See application file for complete search history.

(56) References Cited

U.S. PATENT DOCUMENTS 3,235,682 A * 2/1966 Papworth ..... 200/51.09
3,336,569 A 8/1967 Nava
4,088,383 A 5/1978 Fischer et al.
4,199,213 A 4/1980 Tachick
4,262,987 A 4/1981 Gallusser et al.
4,333,703 A 6/1982 Anhalt et al.
4,464,004 A 8/1984 Hegyi et al.
4,516,823 A 5/1985 Filter et al.
4,822,291 A 4/1989 Cunninham
4,863,392 A 9/1989 Borgstrom et al.
5,393,240 A 2/1995 Makal et al.
5,493,073 A * 2/1996 Honkomp ..... 174/152 GM
5,522,738 A * 6/1996 Lace ..... 439/669
5,525,069 A * 6/1996 Roscizewski et al. ..... 439/184
5,857,862 A 1/1999 Muench et al.
6,042,407 A 3/2000 Scull
6,213,799 B1 * 4/2001 Jazowski et al. ..... 439/181
6,416,338 B1 7/2002 Berlovan
6,796,780 B1 * 9/2004 Chatard et al. ..... 425/1
6,811,418 B1 * 11/2004 Jazowski et al. ..... 439/181

* cited by examiner

*Primary Examiner*—J. F. Duverne
(74) *Attorney, Agent, or Firm*—Marcus R. Mickney; Mark S. Bicks; Alfred N. Goodman

(57) ABSTRACT

An electrical connector, such as a bushing insert, includes a housing with an inner bore, opposite ends. One end has an opening providing access to the inner bore. A piston-contact element is movable between first and second axially spaced positions within the inner bore. During fault closure or short circuit conditions, the piston-contact element accelerates connection with a male contact of an electrical connector, such as a cable connector, thereby inhibiting the formation of flashover or electrical arc.

20 Claims, 7 Drawing Sheets

ELECTRICAL CONNECTOR HAVING A PISTON-CONTACT ELEMENT

FIELD OF THE INVENTION

The present invention generally relates to an electrical connector for a power distribution system. More specifically, the invention relates to an electrical connector, such as a bushing insert, having a snuffer tube assembly including a piston-contact element that moves between retracted and extended positions. During fault closure, the snuffer tube assembly is arranged to accelerate connection of the piston-contact element with a male contact of an electrical connector, thereby overcoming electromagnetic forces inhibiting the formation of flashover or electrical arc and reducing operator risk.

BACKGROUND OF THE INVENTION

Conventional high voltage electrical connectors, such as bushing inserts, connect such devices as transformers to electrical equipment of a power distribution system. Typically the electrical connector is connected to another electrical device of the power distribution system, such as a cable connector, with female contacts of the electrical connector mating with male contacts of the cable connector.

During connection of the electrical connector and cable connector under a load, an arc is struck between the contact elements as they approach one another. The arc formed during loadmake is acceptable since the arc is generally of moderate intensity and is quenched as soon as the contact elements are engaged. However, during fault closure or short circuit conditions, a substantial arc can occur between the contact elements of the connectors resulting in catastrophic failure of the electrical connector including extensive damage and possible explosion.

Conventional electrical connectors employ a piston that moves the female contact of the electrical connector into engagement with the male contact of the cable connector during fault conditions, thereby accelerating the engagement of the contacts, which in turn substantially eliminates any arc formed therebetween. As a result, however, the conventional electrical connectors must be adapted to accommodate the shape of the movable piston which must be of sufficient length to accelerate the connection of the contact elements and eliminate any arc. Examples of high voltage electrical connectors are disclosed in U.S. Pat. No. 3,930,709 to Stanger et al; U.S. Pat. No. 3,982,812 to Boliver; U.S. Pat. No. 4,008,943 to Flatt et al; U.S. Pat. No. 4,119,358 to Tachick et al.; U.S. Pat. No. to Stepniak et al.; U.S. Pat. No. 4,773,872 to Borgstrom et al; and U.S. Pat. No. 5,445,533 to Roscizewski et al, and U.S. Pat. No. 6,416,338 to Berlovan.

SUMMARY OF THE INVENTION

Accordingly, an object of the present invention is to provide an electrical connector that includes a mechanism for accelerating connection of the electrical connector with another electrical device, thereby substantially quenching the formation of any arc therebetween during fault conditions.

Another object of the present invention is to provide an electrical connector that includes a snuffer tube assembly having a unitary piston-contact element for accelerating connection of the electrical connector; since the assembly is integrally connected, assembly is facilitated and manufacturing costs are reduced.

Yet another object of the present invention is to provide an electrical connector that includes a piston-contact element adapted to limit movement in a first direction, while simultaneously allowing for movement of substantially about one inch in a second direction, thereby facilitating a firm connection, thus enhancing reliability and performance of the snuffer tube assembly for eliminating arcing during fault conditions.

The foregoing objects are basically attained by an electrical connector assembly, such as a bushing insert, comprising a piston-contact element having a housing including an inner bore and an open end providing access to said inner bore. The inner bore has an inner surface and a first retaining groove disposed in the inner surface. A piston-contact element is slidably received in the inner bore of the housing through the open end. The piston-contact element is movable between first and second positions and has an outer surface with a second retaining groove disposed in the outer surface. A resilient member is received in each of the first and second retaining grooves and releasably retains the piston-contact element within the inner bore of the housing.

The foregoing objects are also attained by a method of assembling an electrical connector assembly, such as a bushing insert, comprising a housing including an inner bore with a first retaining groove and an open end. A piston-contact element has a second retaining groove and a resilient member. The method steps include coupling the resilient member with a second retaining groove of the piston-contact element, slidably inserting the piston-contact element and resilient member in the inner bore of the housing through an open end, and compressing the resilient member until the resilient member is received in first and second retaining grooves, thereby releasably retaining the piston-contact element in the inner bore of the housing.

By fashioning the electrical connector in this manner, the piston-contact element both facilitates assembly and reduces manufacturing costs, while providing an effective mechanism for accelerating and establishing a firm connection between the contact elements of the electrical connector and a cable connector device during fault closure.

Other objects, advantages and salient features of the invention will become apparent from the following detailed description, which, taken in conjunction with annexed drawings, discloses and preferred embodiments of the present invention.

BRIEF DESCRIPTION OF THE DRAWINGS

Referring to the drawings which form a part of this disclosure.

DETAILED DESCRIPTION OF THE INVENTION

Figure 1:
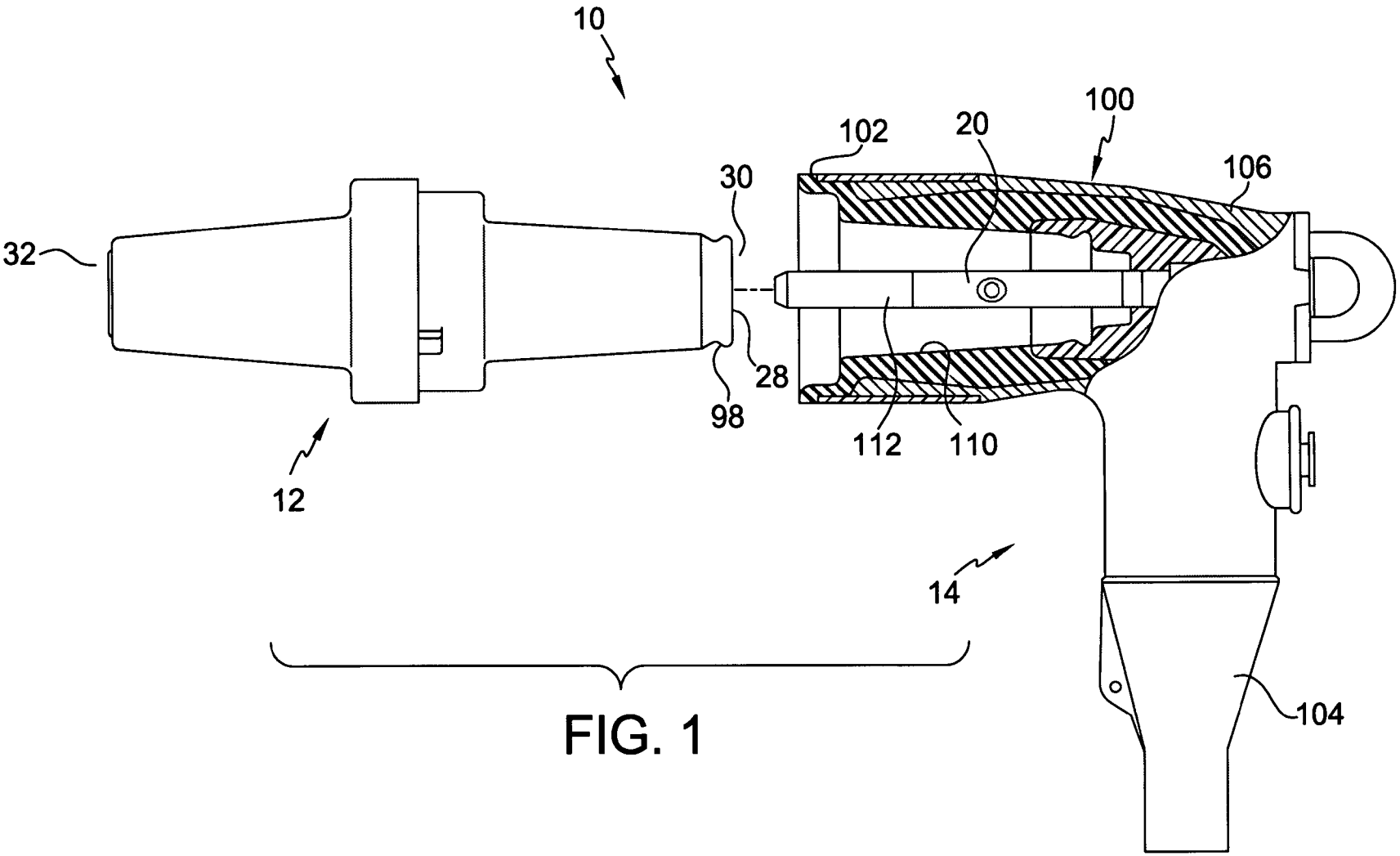
FIG. 1 is a side elevational view in partial cross section of the bushing insert being mated with an electrical connector for a power distribution system in accordance with an embodiment of the present invention.
Figure 2:
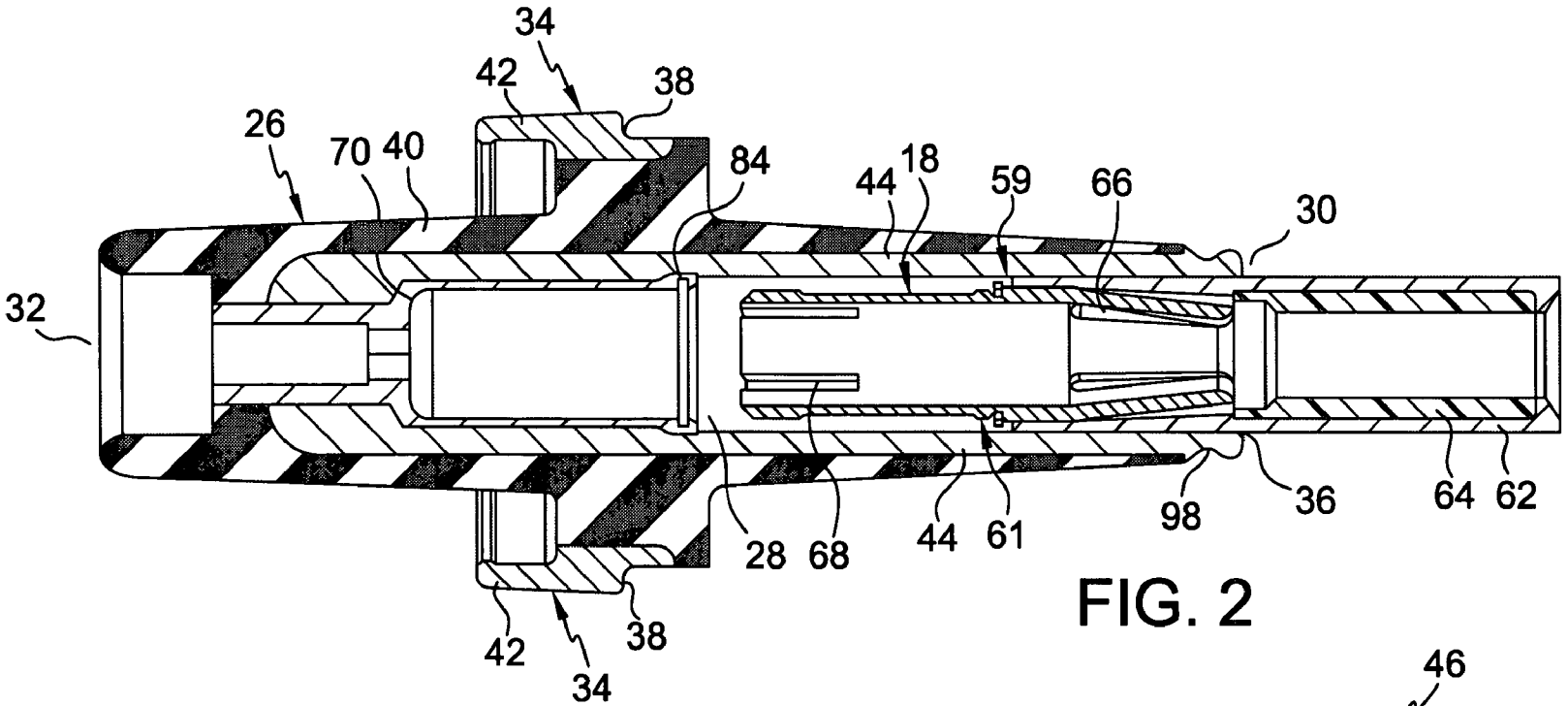
FIG. 2 is a side elevational view in section of the bushing insert of FIG. 1, showing the snuffer tube assembly initially received in an inner bore of the bushing insert.
Figure 3:
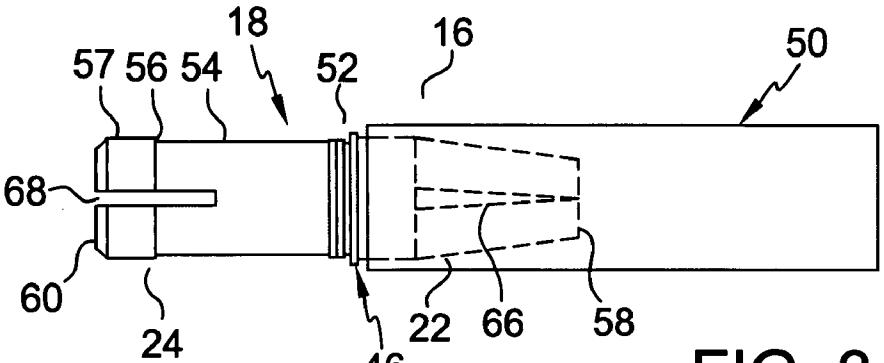
FIG. 3 is a side elevational view in of the snuffer tube assembly of FIG. 2, showing the piston-contact element and the snuffer tube.
Figure 5:
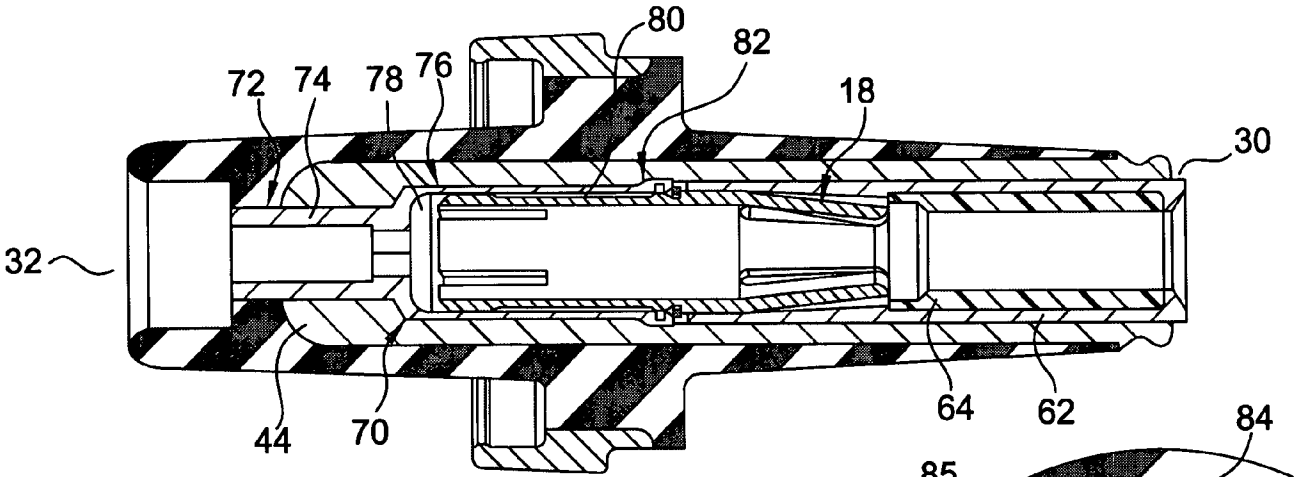
FIG. 5 is a side elevational view in section of the bushing insert of FIG. 2, showing the piston-contact element in a position prior to engagement with the piston subassembly angled wall.
Figure 6:
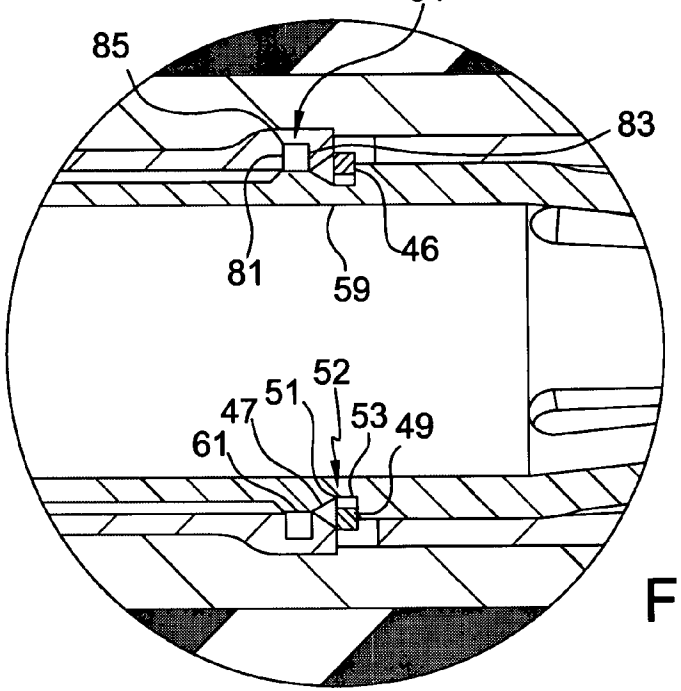
FIG. 6 is an enlarged side elevational view in section of the bushing insert of FIG. 2, showing the piston-contact element in a position prior to engagement with the piston subassembly angled wall.
Figure 7:
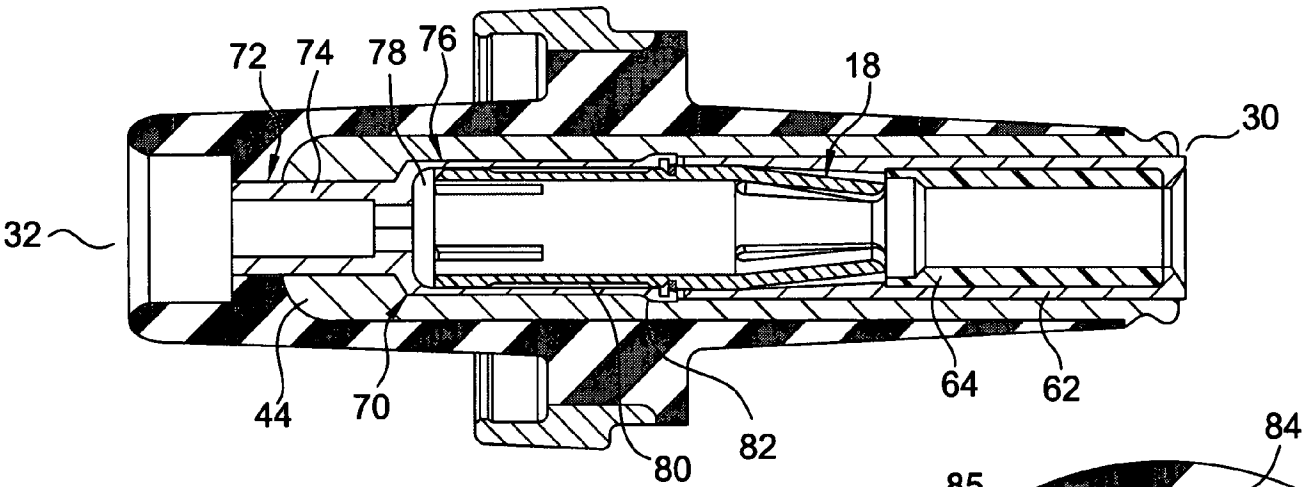
FIG. 7 is a side elevational view in section of the bushing insert of FIG. 2, showing the piston-contact element in an engagement position with the piston subassembly angled wall.
Figure 8:
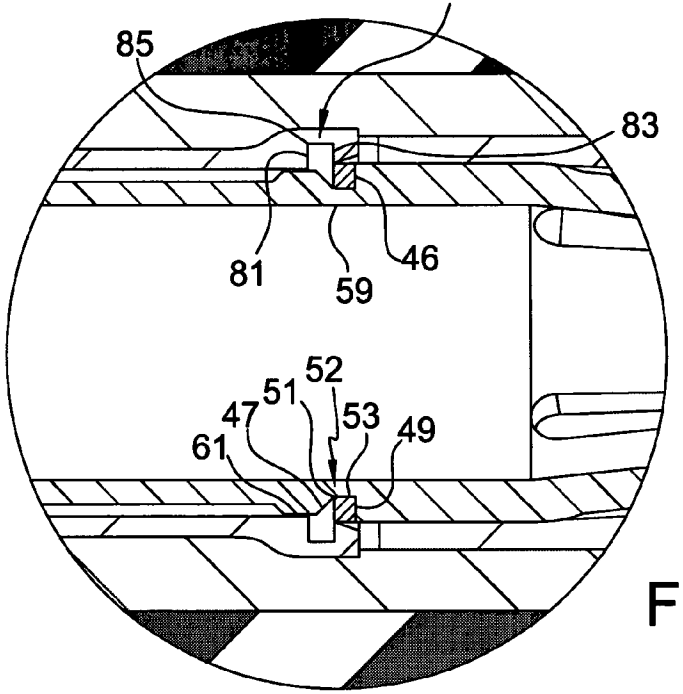
FIG. 8 is an enlarged side elevational view in section of the bushing insert of FIG. 2, showing the piston-contact element in an engagement with the piston subassembly angled wall.

Referring to FIGS. 1–13, an electrical connector assembly 10 of a power distribution system, includes an electrical connector 12, such as a high-voltage bushing insert, adapted to mate with an electrical device 14, such as an elbow cable connector. As best seen in FIGS. 2–3, bushing insert includes a housing 26 with an inner bore 28 for receiving a snuffer tube assembly 16. The snuffer tube assembly has a piston-contact element 18 that engages contact element 20 of cable connector 14. The piston-contact element 18 is movable between first and second axially spaced positions within an inner bore 28 of the bushing insert 12. During fault closure, first and second contact portions 22 and 24 of piston-contact element 18 move toward contact element 20 of cable connector 14 to accelerate engagement thereof and quench any arc that may have formed while the two contact elements 22 and 24 and contact element 20 approach engagement. A resilient member 46 restricts movement of the piston-contact element.

Housing 26 specifically includes a first open end 30 and a second end 32 opposite the first end. A middle portion 34 is positioned between first 30 and second ends 32. First open end 30 is connected to a cable connector 14 through an opening 36 providing access to the inner bore 28. The middle portion 34 is connected to ground. The second end 32 connects to a bushing well (not shown) as is well known and conventional in the art. First and second ends 30, 32 are generally cylindrical with a slight taper from middle portion 34 to the respective end of housing 26. The shape of the first open end portion 30, in particular, is adapted to fit within cable connector 14, as is best seen in FIG. 1. Middle portion 30 is radially wider than the first and second end portions 30 and 32, and has a transition shoulder 38 between the middle portion 34 and first open end portion 30.

Housing 26 of bushing insert 12 is a molded unitary member formed of an insulative body 40 with an outer conductive layer 42 located at the middle portion 34, and an inner conductive casing 44 defining inner bore 28. Outer layer 42 is preferably made of a conductive rubber. Insulative body 40 is preferably made of an insulating rubber. The inner conductive casing 44 is preferably made of conductive rubber or nylon (e.g. insulative glass filled nylon). Alternatively, a conductive paint or adhesive over the top of the nylon may be used. At least a portion the inner casing 44 includes a piston subassembly 70 having a bore retaining groove 84 therein.

Snuffer tube assembly 16 is received within housing inner bore 28. As best seen in FIG. 3, snuffer tube assembly 16 generally includes a piston-contact element 18, a resilient member 46 having a slot 48 for permitting expansion and compression of the resilient member, and a snuffer tube 50. Piston-contact element 18 is made of any conductive material, preferably metal, has a first end 58 and a second end 60, and a middle portion 59. Piston-contact element 18 has an outer surface 54 having a substantially annularly shaped and continuous element retaining groove 52 for receiving the resilient member 46.

As seen in FIGS. 2–3, the snuffer tube 50 is connected to the piston-contact element 18 proximate a first end 58 of the piston-contact element 18, as is well known in the art. As best seen in FIG. 2, the snuffer tube 50 includes an outer sleeve 62 preferably made of conductive rubber or nylon. The snuffer tube also includes an inner ablative member 64 for providing extinguishing gases, as is known in the art.

Piston-contact element first end 58 receives contact 20 of the cable connector 14. The second end 60 also receives contact 20 of the cable connector 14 and acts as a piston. Both first and second ends 58 and 60 may include resilient fingers 66, 68. Resilient probe fingers 66 facilitate engagement of contact element 20 of the cable connector 14 and ensure a good connection. Resilient contact fingers 68 facilitate connection with the piston subassembly 70 and also ensure a good connection. The resilient probe and contact fingers 66, 68 are shaped to allow insertion of the piston-contact element 18 into the inner bore 28 in one direction, while preventing its removal.

Figure 13:
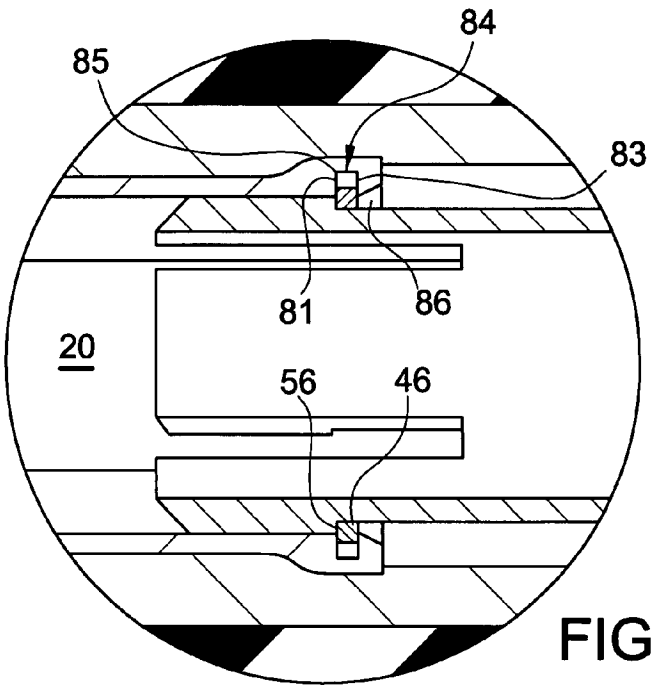
FIG. 13 is an enlarged side elevational view in section of the bushing insert of FIG. 2, showing the piston-contact element in an advanced position.

As best illustrated in FIGS. 3 and 13, the second end 60 of the piston-contact element 18 includes a stopping member 57 having an annular shoulder 56 for abutting the resilient member 46 and limiting travel of the piston-contact element 18 within inner bore 28. The annular shoulder prevents the piston-contact element 18 from advancing more then substantially about one inch towards the first end 30 of the bushing insert 12.

Figure 4:
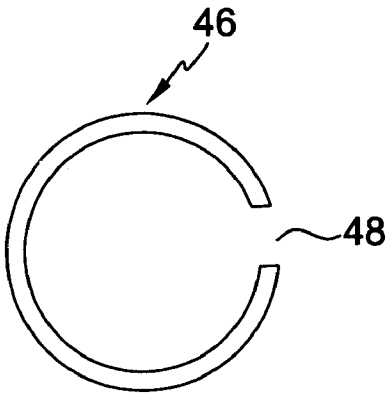
FIG. 4 is a side elevational view of a resilient member for releasably retaining the piston-contact element in the inner bore of the bushing insert.

As illustrated in FIG. 4, resilient member 46 is substantially ring shaped and is preferably spring biased. The resilient member 46 allows the piston-contact element 18 to be slidably inserted into the inner tube 28 of the bushing insert 12 releasably retains the piston-contact element 18 with respect to the inner tube 28 such that the piston-contact element 18 cannot be easily removed. Resilient member 46 also allows piston-contact element 18 to slide with respect to the electrical connector 14 when mating with elbow cable connector 12 during fault conditions.

As illustrated in FIGS. 6, 8, 10, and 13, the piston-contact element retaining groove 52 includes a first side wall 49, a second side wall 51, and an end wall 53 for receiving the resilient member 46. An angled wall 47 extends from the second side wall for facilitating disengagement and spacing of the resilient member 46 from the element retaining groove 52 during fault conditions as seen in FIG. 13.

FIGS. 6, 8, 10, and 12 also illustrate the middle portion 59 of the piston-contact element 18. The middle portion 59 includes a substantially annularly shaped tapered protrusion 61. The tapered protrusion is located proximate the angled wall 47 and has a tapered back side. The tapered protrusion facilitates disengagement of the resilient member 46 from the element retaining groove 52, as best seen in FIG. 11, permitting the piston-contact element 18 to be advanced to a second position during fault conditions as seen in FIG. 13.

The second end 32 of housing 26 includes a bushing well (not shown). A metal (e.g. copper) piston subassembly 70 is releasably connected to the bushing well by any suitable fastening means, preferably by a threadable connection. The piston subassembly is constructed of a metal, preferably copper. As shown in FIGS. 5, 7, 9, and 12, the piston subassembly 70 has a first section 72 and a second section 76. The first section includes a nose cone 74 for mating with the bushing well. The second section 76 has inner and outer surfaces 80, 82. The inner surface 80 defines the perimeter of a substantially U-shaped chamber receiving the piston-contact element 18 of the snuffer tube assembly. The piston subassembly 70 and inner conductive casing 44 are integrally connected, defining an inner surface of the inner bore 28. The piston subassembly 70 may be independently positioned as separate element adjacent to the inner conductive casing 44 or alternatively the inner conductive casing and piston subassembly can be one element.

Figure 9:
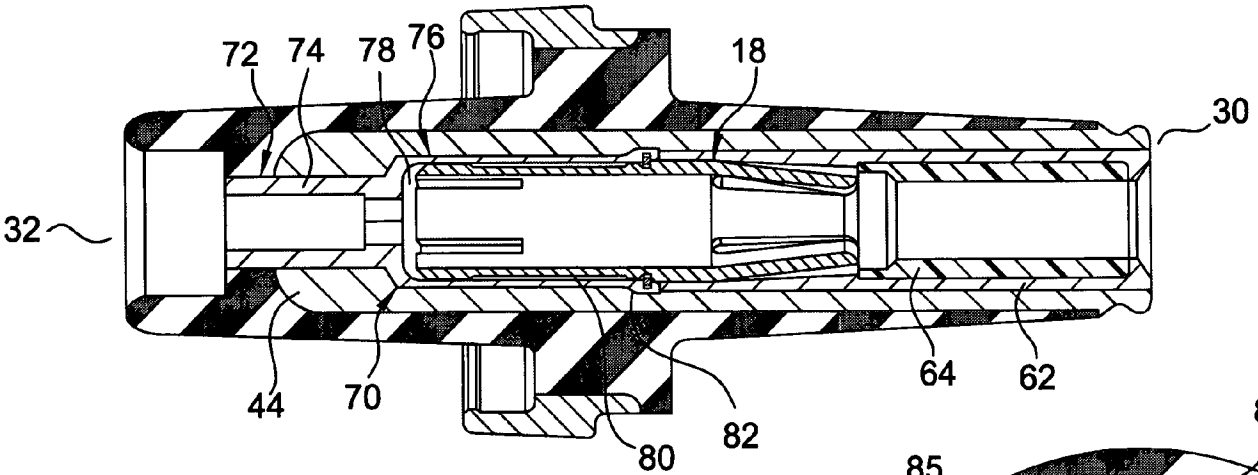
FIG. 9 is a side elevational view in section of the bushing insert of FIG. 2, showing the piston-contact element in the retracted home position.

As best seen in FIG. 9, when the piston-contact element 18 is in the fully retracted home position, a space 78 remains between the U-shaped chamber defined by the inner surface 80 of the piston subassembly 70 and the second end 60 of piston-contact element 18. During fault closure or short circuit conditions, gases are generated which fill the chamber space 78. As the gases occupy the space 78, the pressure within the space 78 increases, generating a force against the second end 60 of piston-contact element 18. This force is sufficient enough to overcome the force applied to the piston-contact element 18 by the resilient member 46.

As best seen in FIGS. 6, 8, 10, and 13, the inner surface 80 of the piston subassembly 70 includes a substantially annularly shaped bore retaining groove 84 having a first side wall 81, a second side wall 83, and an end wall 85. A substantially angled wall 86 extends from the second side wall 83. The substantially annularly shaped bore retaining groove 84 receives the resilient member 46 located on the piston-contact element. The substantially angled wall 86 extends from the inner surface 80 toward the outer surface 82 of the piston subassembly 70. The angled wall 86 facilitates positioning of the piston-contact element 18 in the U-shaped chamber of the piston subassembly 70.

The angled wall 86 guides the piston-contact element 18 into alignment with the annular bore retaining groove 84. Specifically, as the piston-contact element 18 of the snuffer tube assembly is further inserted into the inner bore 28 of the bushing insert 12, the angled wall 86 compresses the resilient member 46. Subsequently, as the piston-contact element 18 is advanced to a position beyond the tapered edge section 86, the compressive force placed upon the resilient member 46 by the angled wall 86 is removed, and the resilient member 46 expands. The resilient member 46 expands and snaps into the corresponding bore retaining groove 84 located on the inner surface 80 of the piston subassembly 70, thereby locking the piston-contact element 18 in the home position, as is best seen in FIG. 9.

OPERATION

Bushing insert 12 connects to cable connector 14. Since cable connector 14 is well known in the art, it will be described only generally. Cable connector 14 includes an insulative housing 100 with first and second ends 102 and 104, and an outer conductive jacket 106, as best seen in FIG. 1. First end 102 includes an opening 108 for receiving bushing insert 12 into a bushing port 110 of connector 14. Extending through bushing port 110 is contact element or conductive probe 20. As best seen in FIGS. 1–2, contact element 20 is received within inner bore 28 of bushing insert 12, through resilient probe fingers 66, upon connection of bushing insert 12 and cable connector 14. Probe 20 includes an insulating ablative member 112 to provide arc quenching gases, as is known in the art. Bushing port 110 is shaped to receive bushing insert 12 second end portion 30. The cable connector 14 includes a groove 114 that mates with an extended lip 98 of bushing insert end portion 30. The second end 104 of cable connector 14 receives a cable that is electrically connected to probe 20. Although cable connector 14 is shown as an elbow or L-shaped connector, bushing insert 12 can be connected to any type of cable connector known in the art.

Referring to FIGS. 5–13, during fault closure, by moving from a retracted to an extended position, snuffer tube assembly 16 accelerates the connection of the piston-contact element 18 and contact 20 of cable connector 14, thereby quenching the formation of arc and preventing injury to the operator. During fault closure, as bushing insert 12 and cable connector 14 approach one another, with insert 12 being inserted into bushing port 110 of connector 14, an arc is formed between contact elements 18 and 20, thus triggering the generation of arc quenching gases from ablative members 25 and 112, as is known in the art.

Figure 10:
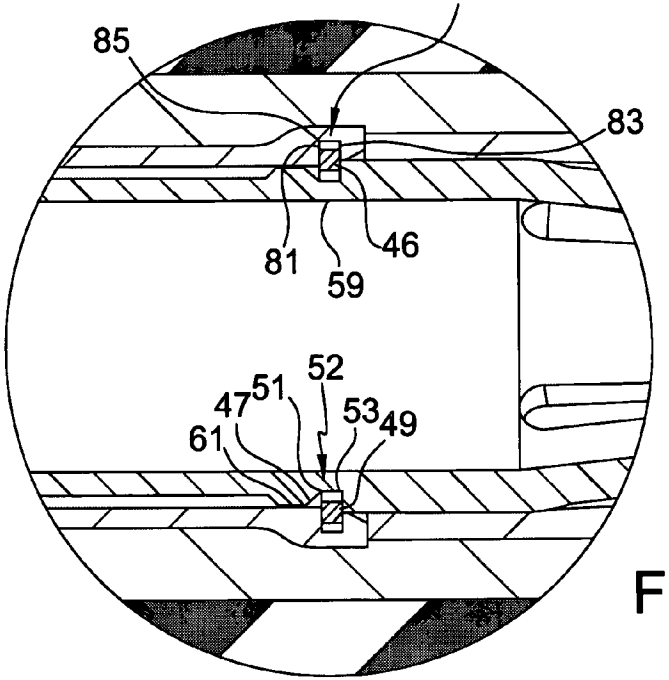
FIG. 10 is an enlarged side elevational view in section of the bushing insert of FIG. 2, showing the piston-contact element in the retracted home position.
Figure 11:
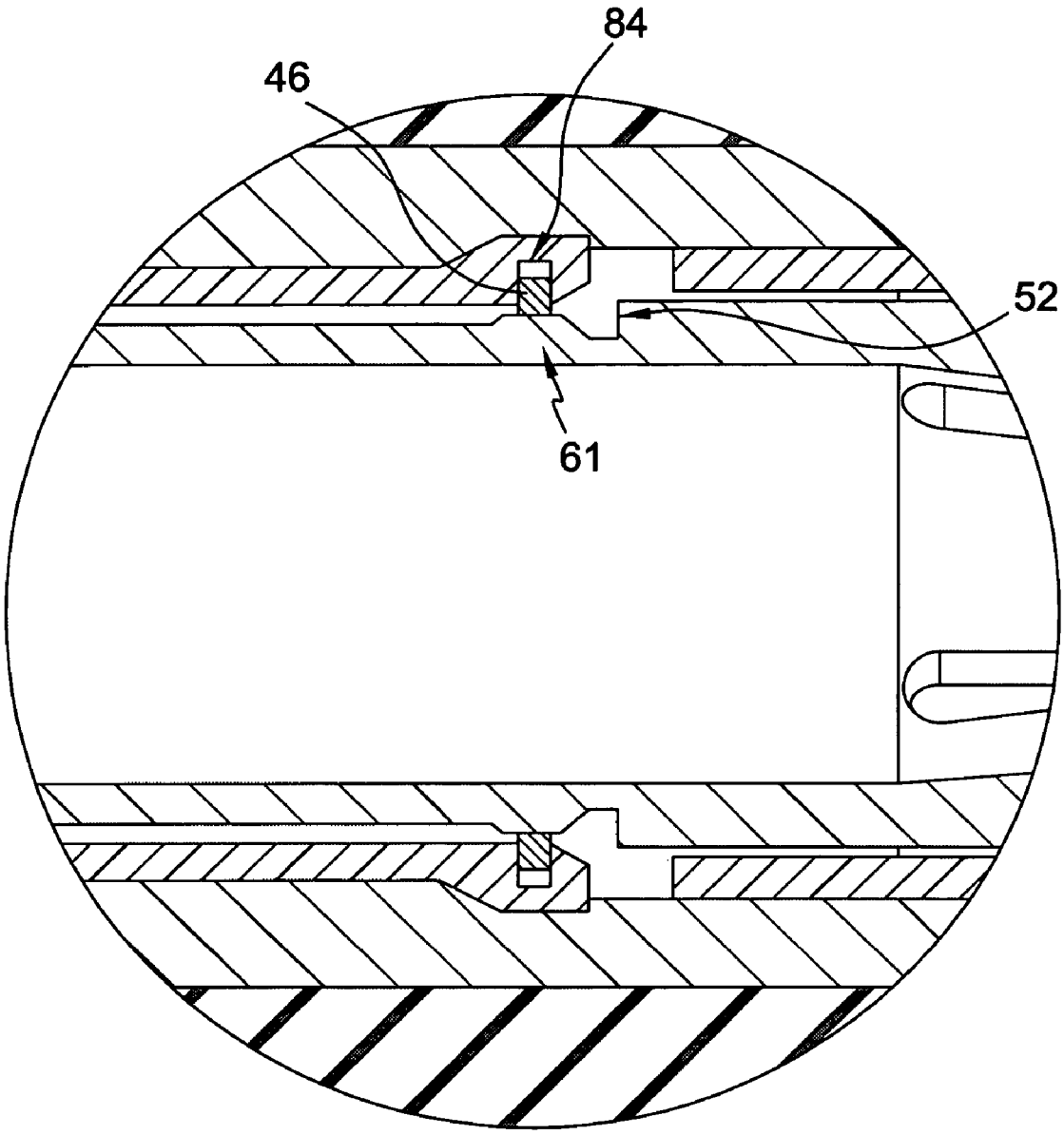
FIG. 11 is an enlarged side elevational view of the piston-contact element tapered protrusion expanding the resilient member and spacing the resilient member from the element retaining groove.
Figure 12:
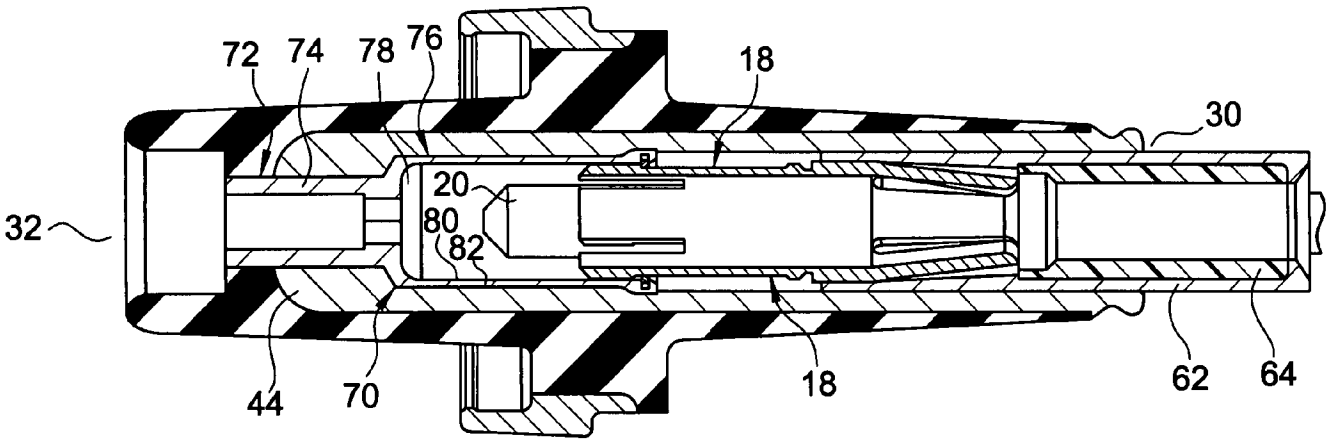
FIG. 12 is a side elevational view in section of the bushing insert of FIG. 2, showing the piston-contact element in an advanced position.

During normal operation, piston-contact assembly 18 is in the retracted home position, as best seen in FIGS. 9–10. During a fault closure, gases are generated. As seen in FIGS. 12–13, as bushing insert 12 is advanced further into bushing port 110 of connector 14, the generated gases from the ablative members 25 112 fill up space 78 located in the U-shaped chamber of the piston subassembly 70 by passing around the piston-contact assembly or through the interior cavity of the piston-contact element 18. As the gases occupy space 78, the pressure increases, and thus a force acts upon the second end 60 of the piston-contact element 18 and initiates movement by overcoming the force applied by resilient member 46.

Consequently, piston-contact element 18 is forced in a direction towards the first end 30 of the bushing insert. As the piston-contact element 18 is advanced, angled wall 47 of the element retaining groove 52 initiates an expansion force against the resilient member 46. The force increases as the piston-contact element 18 is advanced. The force acting upon the resilient member 46 increases until tapered protrusion 61 is reached, and the expansion force plateaus, as best seen in FIG. 11. During this time, the piston-contact element 18 is released from resilient member 46 and permitted to advance towards the first end 30 of the bushing insert under pressure from the generated gases, thus accelerating the connection of contact elements 18 and 20. However, the piston-contact element 18 can only be advanced a limited distance. The annular shoulder 56 of the piston-contact element stop 57 prevents any further advancement when engaged by resilient member 46. The snuffer tube assembly 16 will only be permitted to travel within the inner bore 28 substantially about one inch.

Under normal operating conditions, that is other than fault conditions, the intensity of the arc is moderate and thus does not create enough pressure in the piston subassembly 70 chamber space 78 to move the piston-contact element 18.

Thus, it is generally only under fault conditions that the piston-contact element 18 moves between retracted and advanced positions.

While a particular embodiment has been chosen to illustrate the invention, it will be understood by those skilled in the art that various changes and modifications can be made therein without departing from the scope of the invention as defined in the appended claims.

What is claimed is:

1. An electrical connector, comprising:

a housing including an inner bore and an open end providing access to said inner bore, said inner bore having an inner surface and a bore retaining groove disposed in said inner surface;

a piston-contact element slidably received in said inner bore of said housing though said open end, said piston-contact element being axially movable between retracted and advanced positions and having an outer surface with an element retaining groove disposed in said outer surface; and a resilient member received in each of said retaining grooves releasably retaining said piston-contact element in one of said retracted and advanced positions within said inner bore of said housing.

2. An electrical connector according to claim 1, wherein said piston-contact element is in said retracted position when said resilient member is received in said element retaining grooves; and said piston-contact element is in said advanced position when said resilient member is received in said bore retaining groove and spaced from said element retaining groove.

3. An electrical connector according to claim 1, wherein said piston-contact element includes opposing first and second ends;

said first end is adapted to engage another electrical connector; and said second end includes a stop substantially preventing removal of contact member from said inner bore of said housing.

4. An electrical comiector according to claim 3, wherein said stop comprises an annular shoulder abutting said resilient member in the other of said retracted and advanced positions.

5. An electrical connector according to claim 3, wherein said first end of said piston-contact element includes probe fingers; and said second end is a piston.

6. An electrical connector according to claim 5, wherein said probe fingers and said piston-contact element together form a unitary, one-piece member.

7. An electrical connector according to claim 1, wherein said retaining grooves are each substantially annular and continuous.

8. An electrical connector according to claim 1, wherein said bore retaining groove includes first and second side walls and an end wall extending therebetween; and an angled wall extends from said second side wall facilitating engagement of said resilient member in said bore retaining groove.

9. An electrical connector according to claim 1, wherein said element retaining groove includes first and second side walls and an end wall extending therebetween, said second side wall being angled with respect to said first side wall facilitating disengagement of said resilient member from said element retaining groove.

10. An electrical connector according to claim 1, wherein said resilient member is a substantially ring shaped spring.

11. An electrical connector according to claim 10, wherein said resilient member includes a slot allowing expansion and compression of said resilient member.

12. An electrical connector according to claim 1, wherein an electrical contact of another electrical connector is received in said inner bore of said housing through said open end engaging said piston-contact element.

13. An electrical connector according to claim 1, wherein said housing includes an inner conductive sleeve; and said bore retaining groove is disposed in said conductive sleeve.

14. An electrical connector according to claim 1, wherein said electrical connector is a high-voltage bushing insert.

15. An electrical connector according to claim 2, wherein said resilient member is received in both said element and bore retaining grooves when said piston-contact element is in said retracted position.

16. A high-voltage bushing insert for mating with a cable connector, comprising:

a housing including an inner bore and an open end providing access to said inner bore, said inner bore having an inner surface and a bore retaining groove disposed in said inner surface;

a piston-contact element slidably received in said inner bore of said housing though said open end and having an outer surface with an element retaining groove disposed in said outer surface; and a resilient member received in each of said retaining grooves releasably retaining said piston-contact element in one of a retracted and advanced positions within said inner bore of said housing, said piston-contact element being in said retracted position during normal operation and being moved to said advanced position by gases generated during fault conditions.

17. A high-voltage bushing insert according to claim 16, wherein said piston-contact element is in said retracted position when said resilient member is received in said element retaining groove; and said piston-contact element is in said advanced position when said resilient member is received in said bore retaining groove and spaced from said element retaining groove.

18. A high-voltage bushing insert according to claim 17, wherein said resilient member is received in both said element and bore retaining grooves when said piston-contact element is in said retracted position.

19. A high-voltage bushing insert according to claim 17, wherein an annular shoulder extending outwardly from said outer surface of said piston-contact element engages said resilient member in said advanced position to substantially prevent removal of said piston-contact element from said inner bore of said housing.

20. A high-voltage bushing insert according to claim 16, wherein a snuffer tube disposed within said piston-contact element generates said gases during fault conditions.

* * * * *